United States Patent [19]

Procton

[11] 4,224,766

[45] Sep. 30, 1980

[54] THRESHOLD WITH FLEXIBLE INSULATOR

[75] Inventor: Jerome C. Procton, Greensboro, N.C.

[73] Assignee: Endura Products, Inc., Greensboro, N.C.

[21] Appl. No.: 40,657

[22] Filed: May 21, 1979

[51] Int. Cl.[3] ..... E06B 1/70

[52] U.S. Cl. ..... 49/468; 49/469

[58] Field of Search ..... 49/467–469, 49/DIG. 1, 482

[56] References Cited

U.S. PATENT DOCUMENTS

| | | | |
|---|---|---|---|
| 1,178,859 | 4/1916 | Krause | 49/468 |
| 3,254,453 | 6/1966 | Dennis | 49/482 |
| 3,468,064 | 9/1969 | Fraleigh et al. | 49/DIG. 1 |
| 4,003,162 | 1/1977 | Britt | 49/468 |

*Primary Examiner*—Kenneth Downey

[57] ABSTRACT

An insulating threshold having an elongated sill with an adjustable elongated flexible arched member in which the height of the arched member may be controlled to engage the bottom of a door.

3 Claims, 5 Drawing Figures

THRESHOLD WITH FLEXIBLE INSULATOR

BACKGROUND AND OBJECTIVES OF THE INVENTION

Wood and metal thresholds and sills of various constructions and contours for utilization in doorways have incorporated various devices to incorporate a better union or fit between the door bottom and the threshold when the door is closed while avoiding, as much as possible, objectionable protrusion. It has also been a problem for carpenters to install thresholds in new construction and in renovations to accomodate doors of different sizes and various types of floor coverings by avoiding unduly undercutting the bottom of the door to obtain a proper fit which will include an insulating barrier between the door bottom and the sill or threshold. Frequently, shims may be required to align a threshold properly or to tilt it in the proper direction depending upon the manner in which the door may be hung and the nature of the particular floor on which the sill is to be installed.

It is an objective of this invention to provide a threshold, preferably of extruded aluminum or other suitable metal in which an elongated flexible arched member is secured to a sill to engage the bottom of a door.

Another objective of this invention is the provision of a threshold which may be extruded of aluminum in which an elongated insulated flexible arched member is provided intermediate the width of the threshold and in which the height of the arch may be adjusted conveniently without disassembling the threshold.

Yet a further objective of this invention is to provide a threshold in which an insulating flexible member may be arched to the desired elevation to engage the bottom of the door and readjustments may be made periodically depending upon wear and the flexible member may be replaced.

Still a further objective of this invention is the provision of a threshold having an elongated flexible insulating member intermediate the width of the threshold which may be adjustable in increment to engage the bottom of a door that may be uneven.

Other objectives and many of the attendant objectives of this threshold will be readily apparent to those skilled in the building art taken in conjunction with the accompanying detailed description and drawing and the appended claims in which equivalence and modifications are contemplated.

BRIEF DESCRIPTION OF THE DRAWING

A preferred embodiment is illustrated in the drawing in which.

DETAILED DESCRIPTION OF PREFERRED EMBODIMENT OF THE INVENTION

Figure 1:
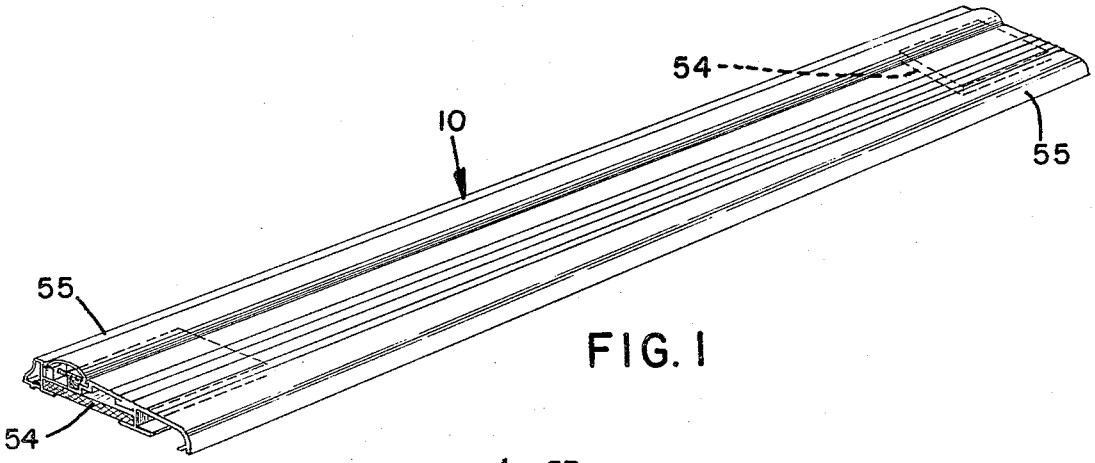
FIG. 1 is a front perspective view of a threshold embodying the present invention.
Figure 2:
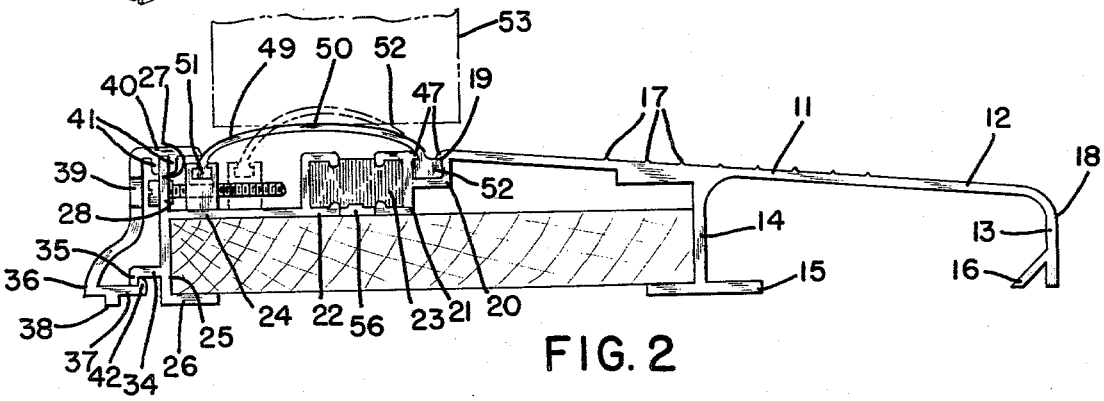
FIG. 2 is an enlarged end view of the threshold of FIG. 1 illustrating an outline form and alternative position of an insulating flexible arched member thereon.
Figure 4:
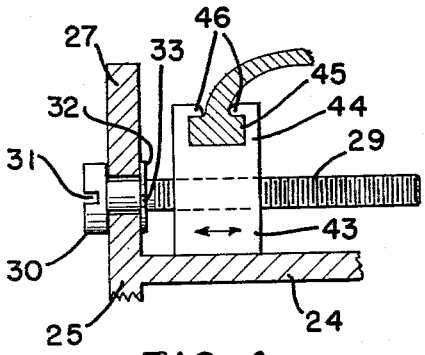
FIG. 4 is a partial enlarged end view of the adjustable clamping moveable retaining block as shown in the assembly of FIG. 2.
Figure 3:
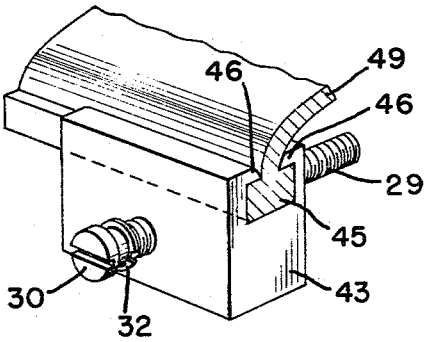
FIG. 3 is a partial enlarged perspective view of one edge of the flexible insulating member and a clamping moveable block for retaining the edge of an insulating flexible member.
Figure 5:
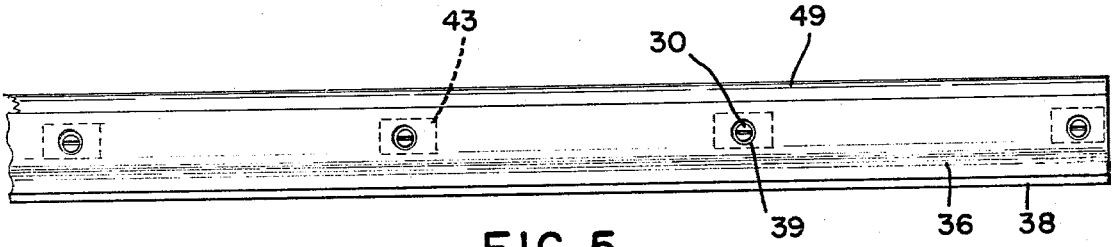
FIG. 5 is a partial left end view of FIG. 2.

Referring to the drawing and particularly to FIGS. 1 and 2, there is illustrated a threshold 10 which is preferably fabricated of extruded aluminum having the desired cross-sectional structure which will support the forward section 11 of the sill 12 by means of appropriate vertically extending ribs 13 and 14 that are suitably spaced from each other with ground-engaging pads 15 and 16. The sill 12 shown in FIG. 2, by way of cross-section, is provided with a series of elongated spaced-apart ridges 17 for avoiding slippage. The sill 12 is inclined upwardly from the front curved wall 18 to the elongated recessed section 19 which is substantially rectangular cross-section with the surrounding wall 20 that abuts the downwardly projecting adjacent C-section 21 which cooperates with an oppositely positioned C-section 22 for cooperatively receiving therein a suitable plastic member 23 which serves as a thermal joint for thermal barrier. A horizontal section 24 extends laterally from the C-section 22 to engage the vertical wall 25 on which the ground engaging pad 26 is formed.

The upper section 27 of the wall 25 is provided with a series of spaced-apart screw-receiving openings 28 for cooperatively receiving therein a threaded screw 29 having the head end 30 with the slot 31 therein secured within the opening 28 by means of the split washer 32 that is retained in the circumferential recess 33 in the screw 29 to maintain the screw in position. A projecting locking lug 34 extends from the wall 25 and is provided with a downwardly extending shoulder 35 thereon. A removable rear facial plate 36 having the desired contour has a bottom section 37 with a ground-engaging projection 38 thereon. The upper portion of the facial plate 36 is provided with a series of spaced-apart openings 39 through which the head 30 of the screw 29 may be accessible with a screwdriver to turn the screw 29 in the appropriate direction. The upper section 40 of the facial plate 36 is provided with a pair of spaced-apart downwardly extending lugs 41 to engage the top end of the wall 25 for retention thereon and for the hook end 42 to engage releasibly the shoulder 35 to retain the facial plate 36 in position.

A threaded block 43 is mounted on each of the series of screws 29 for displacement along the studded screw upon rotation of the head 30 of the screw 29. The upper section 44 of each of the blocks 43 is provided with an elongated recess 45 with inwardly projecting clamping tabs 46. Similar tabs 47 are provided in the elongated recessed section 19.

An elongated flexible insulating member 49 having an intermediate arched section 50 with enlarged terminal edges 51 and 52 is supported intermediate the width of the upper sill section. The enlarged edge 51 is securely retained within the recess 45 in each of the moveable blocks 43 by means of the tabs 46 with the other enlarged elongated edge 52 being retained in the recess 19 by means of the tabs 47. The flexible arched member 49 may be of semi-rigid but flexible plastic that will support substantial loading thereon without breaking as well as be resistant to wear whether from abrasion of the bottom of the door or from persons scuffing thereover. The radius of curvature of the arched section 50 of the flexible member 49 will vary depending upon the cavity formed by the door bottom 52 of the door 53.

After installation with the appropriate leveling and securement to the floor, and hanging of the door 53 in its frame, the proper engagement of the insulating flexible arched member 49 may be adjustably positioned as to the proper height by rotation of the head 30 of the screw 29 through the opening 39. Upon being subjected to prolonged wear, the height of the arched member 49 may be modified in the event a space appears between the bottom 52 of the door 53 by again adjusting the head 30 of screw 29 for a tighter union between the flexible member 49 and the door bottom 52.

Replacement of the flexible member 49 may be achieved by removing the worn member and replacing it with another one.

It will be readily apparent that in place of the individual blocks 43, a single elongated edge retaining block may be utilized which may also have a series of spaced-apart screws 29 having heads 30 retained therein for appropriate adjustment of the flexible member 49.

It is desirable to have wooden blocks 54 inserted in the end section 55 of the threshold 10 so that the threshold may be secured in position by nailing or inserting screws appropriately to the jambs on which the threshold will be supported.

It is contemplated that although the adjustable flexible insulating member 49 is used in conjunction with an aluminum extrusion, it may readily be employed with a fabricated construction. In the embodiment illustrated, the main sill section 12 is extruded as an integral member with the facial plate 36 being extruded separately. However, with the plastic member 23 in position, the recess 56 is formed by milling out an elongated section formed in the extrusion after plastic insert has been set in place permitting the plastic to serve as a thermal joint.

I claim:

1. An insulating adjustable threshold comprising; an elongated sill, an arched flexible means projecting above said sill, said arched flexible means being integral and having a first elongated edge, a second elongated edge and an intermediate flexible member between said edges, means supporting said arched flexible means for controlling the height of said arched flexible means, said flexible means supporting means including a first elongated stationary recess in said sill for retaining said first elongated edge therein and an elongated movable edge supporting means having a second edge retaining recess therein in spaced relation to said first recess, means for displacing said elongated movable edge supporting means to alter the height of said arched flexible means, said movable elongated member including a series of blocks, each of said blocks having a recess for retaining said second elongated edge, means for displacing each of said blocks to adjust the height of said flexible member, and an elongated facial plate mounted on said sill adjacent to said series of blocks and said means for displacing each of said blocks.

2. An insulating adjustable threshold as claimed in claim 1, said elongated facial plate being releasably clamped to said sill and having access means therethrough to expose said block displacing means.

3. An insulating adjustable threshold as claimed in claim 1, said threshold having wood sections at least at each end retained in said sill.

* * * * *